US007213707B2

(12) United States Patent
Hubbs et al.

(10) Patent No.: US 7,213,707 B2
(45) Date of Patent: May 8, 2007

(54) PRODUCT SHIPPING AND DISPLAY CARTON

(75) Inventors: William Hubbs, Barrington, IL (US); Chris Galardi, Gurnee, IL (US); James Trappani, Fort Lauderdale, FL (US)

(73) Assignee: Walgreen Co., Deerfield, IL (US)

( * ) Notice: Subject to any disclaimer, the term of this patent is extended or adjusted under 35 U.S.C. 154(b) by 142 days.

(21) Appl. No.: 10/099,423

(22) Filed: Mar. 15, 2002

(65) Prior Publication Data

US 2003/0106835 A1 Jun. 12, 2003

Related U.S. Application Data

(60) Provisional application No. 60/339,433, filed on Dec. 11, 2001.

(51) Int. Cl.
*B65D 85/20* (2006.01)

(52) U.S. Cl. ..... 206/443; 206/575; 206/391; 206/775; 206/225; 220/8; 220/4.21

(58) Field of Classification Search ..... 206/446, 206/443, 772, 769, 774, 767, 736, 575, 225, 206/391, 403, 270, 775, 781; 229/125.23, 229/125.21, 132, 87.19, 923, 129, 125.125, 229/125.13, 117.21; 220/644, 645, 8 X, 220/4.21 X, 4.24, 4.27
See application file for complete search history.

(56) References Cited

U.S. PATENT DOCUMENTS

| | | | | |
|---|---|---|---|---|
| 476,765 | A | 6/1892 | Knapp | |
| 1,128,052 | A | 2/1915 | Roy | |
| 2,001,140 | A * | 5/1935 | Jordan | 229/125.21 |
| 2,761,610 | A * | 9/1956 | Welshenbach | 229/117.16 |
| 3,343,659 | A * | 9/1967 | Marondel | 206/772 |
| 3,756,499 | A * | 9/1973 | Giebel et al. | 229/117.17 |
| 3,982,690 | A * | 9/1976 | Krizan et al. | 232/17 |
| 4,217,984 | A * | 8/1980 | Magnuson | 206/403 |
| 4,363,405 | A * | 12/1982 | Christie | 206/774 |
| 4,444,313 | A | 4/1984 | Tyson | |
| 4,638,745 | A | 1/1987 | Sheffer | |
| 5,167,324 | A | 12/1992 | Miller | |
| 5,417,342 | A * | 5/1995 | Hutchison | 229/122.32 |

(Continued)

*Primary Examiner*—Jila M. Mohandesi
(74) *Attorney, Agent, or Firm*—Marshall, Gerstein & Borun LLP; Francis C. Kowalik

(57) ABSTRACT

In order to facilitate the shipping and display of products for selection and purchase by a consumer, the product shipping and display carton includes a display box, a shipping sleeve, and a removable fastener. The display box is defined by a bottom panel and an upwardly extending wall panel together forming a product carrying enclosure. The display box has an open top defined by a top wall panel edge opposite the bottom panel. The wall panel has a removable panel portion below the open top defining a product viewing window in the display box. The shipping sleeve is defined by a top panel and a downwardly extending wall panel together forming a telescoping enclosure. The shipping sleeve has an open bottom defined by a bottom wall panel edge opposite the top panel. The display box is positioned in the telescoping enclosure such that the open top is covered by the shipping sleeve. With this arrangement, the removable fastener secures the shipping sleeve to the display box during shipment and permits removal of the shipping sleeve from the display box after shipment to display product disposed within the product carrying enclosure of the display box.

15 Claims, 3 Drawing Sheets

U.S. PATENT DOCUMENTS 5,474,171 A 12/1995 Niesen et al.
6,123,197 A * 9/2000 Marquez et al. ..... 206/575
6,135,288 A * 10/2000 Kim ..... 206/738
6,135,289 A 10/2000 Miller
6,371,365 B1 4/2002 Doucette et al.
2001/0040111 A1* 11/2001 Spradlin et al. ..... 206/391
2006/0191818 A1 8/2006 Hubbs et al.

* cited by examiner

PRODUCT SHIPPING AND DISPLAY CARTON

CROSS-REFERENCE TO RELATED APPLICATION

This application claims the benefit under 35 U.S.C. § 119(e) of U.S. provisional patent application Ser. No. 60/339,433 filed Dec. 11, 2001, the disclosure of which is incorporated herein by reference.

FIELD OF THE INVENTION

The present invention is generally directed to product cartons and, more particularly, to a carton that serves to both ship and display a product.

BACKGROUND OF THE INVENTION

For many products, a carton is used to ship them from the point of manufacture to the destination at which they will be sold. This is especially true of many smaller consumer goods which are suitable for shipping in a relatively large quantity within a single carton. Typically, when the carton arrives at the sales destination, the products are removed from the carton and placed on a shelf for selection and purchase by a consumer.

As is known, there are a number of problems that are inherent in the shipping of products in this manner. First, there is the problem of in-store labor that is required to remove the product from the carton and place the products on a shelf. This is obviously a tedious and time-consuming process which must be repeated as the product is depleted from the store shelf. Second, the carton in which the product is shipped has no other function than transporting the products to the store. This means that there is considerable waste inherent in having to dispose of the carton while utilizing it for only a single function. Third, the placement of the products on a store shelf requires store personnel to print out and apply signage at the product display area. This adds to the overall cost of operation in a business that is notorious for slim profit margins. For all of these reasons, there has been a need for combining the shipment and display of products in a single carton.

SUMMARY OF THE INVENTION

Accordingly, the present invention is directed to a product shipping and display carton that includes a display box, a shipping sleeve, and a removable fastener. The display box is defined by a bottom panel and an upwardly extending wall panel together forming a product carrying enclosure. The display box has an open top defined by a top wall panel edge opposite the bottom panel. The wall panel has a removable panel portion below the open top defining a product viewing window in the display box. The shipping sleeve is defined by a top panel and a downwardly extending wall panel together forming a telescoping enclosure. The shipping sleeve has an open bottom defined by a bottom wall panel edge opposite the top panel. The display box is positioned in the telescoping enclosure such that the open top is covered by the shipping sleeve. With this arrangement, the removable fastener secures the shipping sleeve to the display box during shipment and permits removal of the shipping sleeve from the display box after shipment.

As will be appreciated, the product shipping and display carton makes is possible to display product disposed within the product carrying enclosure of the display box after the shipping sleeve has been removed following arrival at a sales location.

In an exemplary embodiment, the upwardly extending wall panel is defined by a front wall, a rear wall, and a pair of side walls and the removable panel portion is formed in the front wall at a point spaced above the bottom panel. The removable panel portion advantageously extends entirely from one of the side walls to the other of the side walls and is integrally associated with the side walls at a plurality of discreet points along front edges thereof. The front wall advantageously comprises a bottom product-restraining rail integral with the bottom wall panel and a reinforced top product-restraining rail integral with the side walls adjacent the top wall panel edge. Additionally, the display box and the shipping sleeve may both be formed of a corrugated material and the display box may include printed indicia relating to purchasing product contained therewithin.

In one specific application, the display box forms a product carrying and supporting enclosure for elongated holiday gift wrap tubes. The shipping sleeve advantageously completely covers the open top of the display box to protect the elongated holiday gift wrap tubes contained therewithin during shipping. Still additionally, the removable fastener permits removal of the shipping sleeve from the display box to display the elongated holiday gift wrap tubes disposed within the product carrying and supporting enclosure of the display box.

In still other respects, the removable panel portion is preferably formed and has a portion of the front wall at a point spaced above the bottom panel of the display box. In its application for shipping and displaying elongated holiday gift wrap tubes, the front wall again comprises a bottom rail and a reinforced rail which accomplish the objective of supporting the gift wrap tubes vertically within the display box. With regard to the removable panel portion, it will be appreciated that it is disposed below the open top of the display box to form a viewing window for the elongated holiday gift wrap tubes.

Other objects, advantages and features of the present invention will become apparent from a consideration of the following specification taken in conjunction with the accompanying drawings.

DETAILED DESCRIPTION OF THE PREFERRED EMBODIMENT

Figure 1:
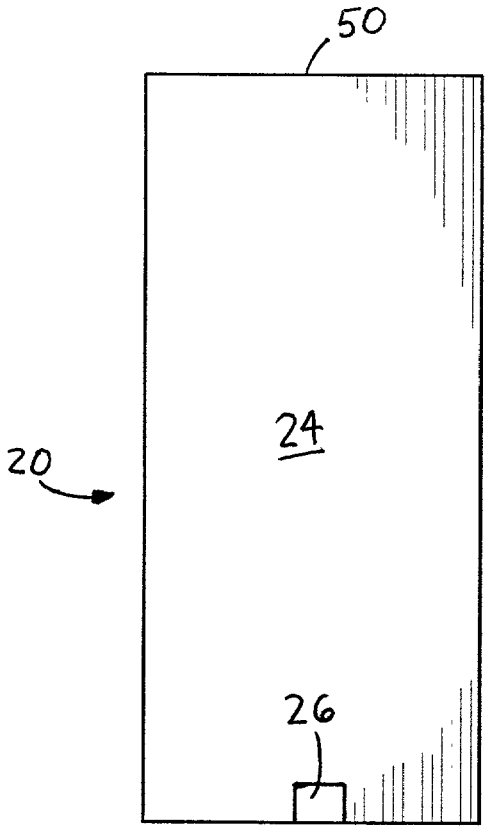
FIG. 1 is a front elevational view of a product shipping and display carton in accordance with the present invention.
Figure 2:
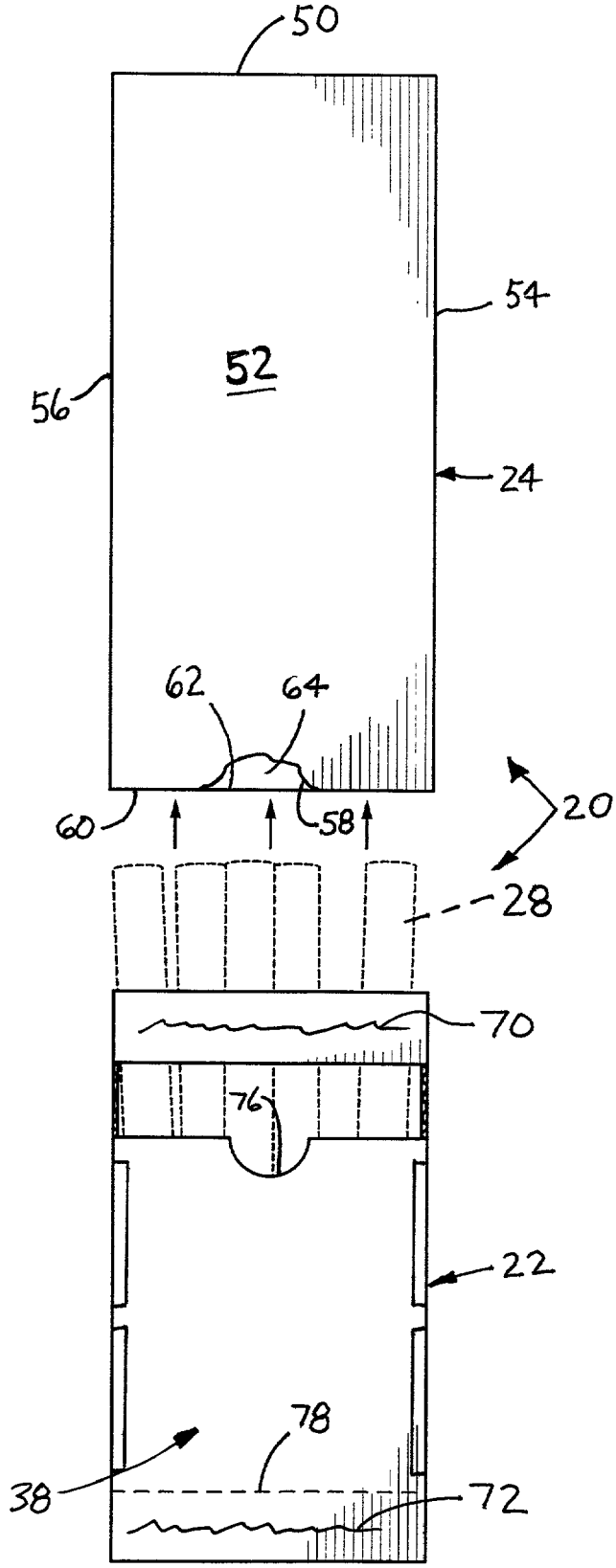
FIG. 2 is a view similar to FIG. 1 but with the shipping sleeve being telescopically removed from the display box.

In the illustrations given, and with reference first to FIGS. 1 and 2, the reference numeral 20 designates generally a product shipping and display carton in accordance with the present invention. The product shipping and display carton 20 includes a display box 22, a shipping sleeve 24, and a removable fastener 26 which may take the form of shipping carton tape. While the carton 20 is useful for shipping and displaying a number of products, it will be described in connection with only a single such product, i.e., elongated holiday gift wrap tubes 28.

Referring now to FIGS. 3–7, it will be seen that the display box 22 is defined by a bottom panel 30, and a plurality of upwardly extending wall panels together forming a carrying and supporting enclosure 32 for the elongated holiday gift wrap tubes 28. The display box 22 includes an open top 34 having a generally rectangular configuration defined by a top wall panel edge 36 disposed opposite the bottom panel 30. The plurality of upwardly extending wall panels includes front and rear wall panels 38 and 40 and a pair of substantially identical side wall panels 42 and 44 and the front wall panel 38 has a removable panel portion 46 below the top wall panel edge 36 defining the open top 34 to form a viewing window 48 (see FIG. 10).

Figure 3:
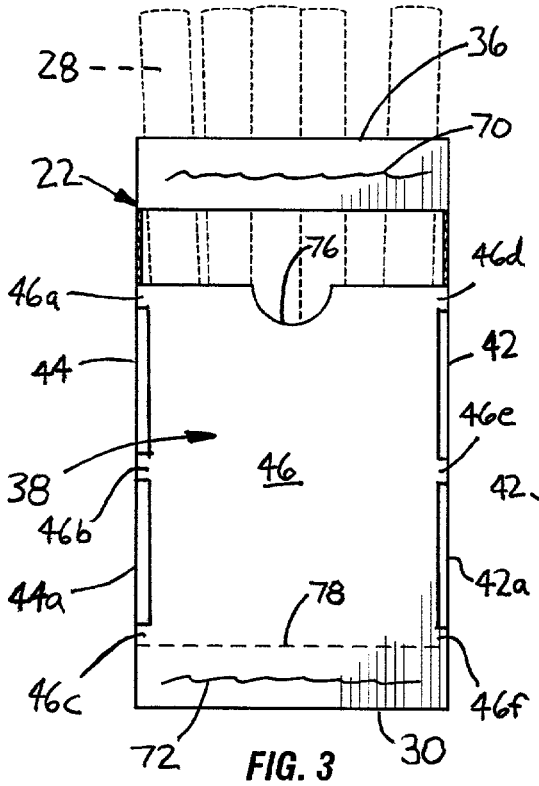
FIG. 3 is a front elevational view of the product shipping and display carton after removal of the shipping sleeve.
Figure 4:
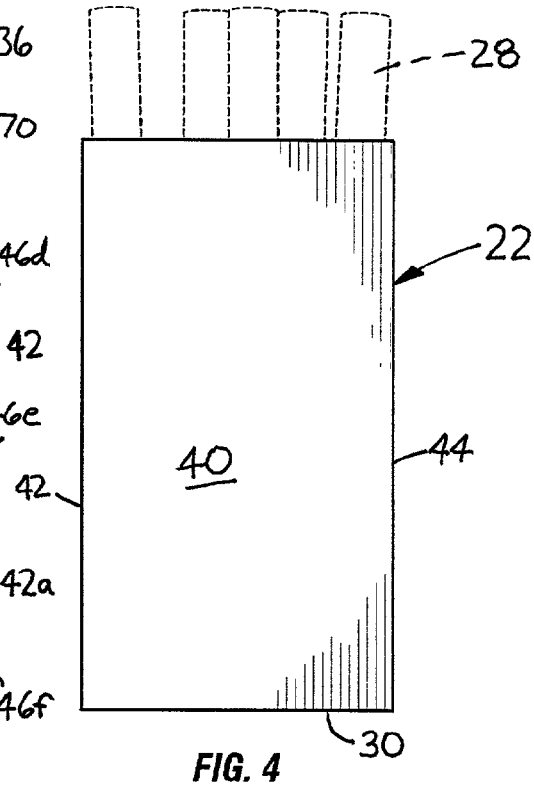
FIG. 4 is a rear elevational view of the product shipping and display carton of FIG. 3.
Figure 5:
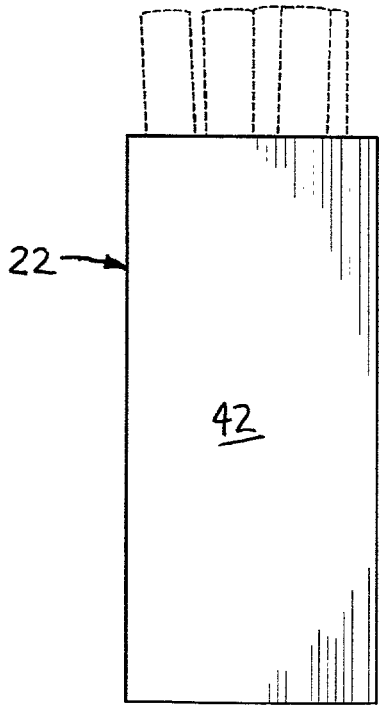
FIG. 5 is a side elevational view of the product shipping and display carton of FIG. 3.
Figure 6:
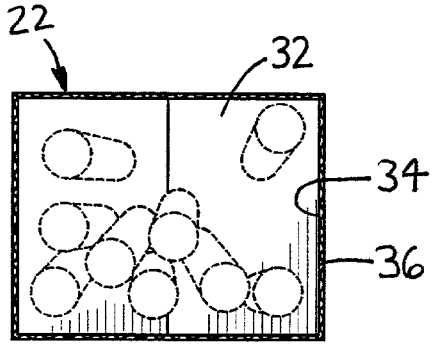
FIG. 6 is a top plan view of the product shipping and display carton of FIG. 3.
Figure 7:
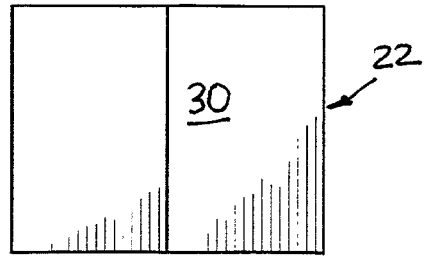
FIG. 7 is a bottom plan view of the product shipping and display carton of FIG. 3.
Figure 8:
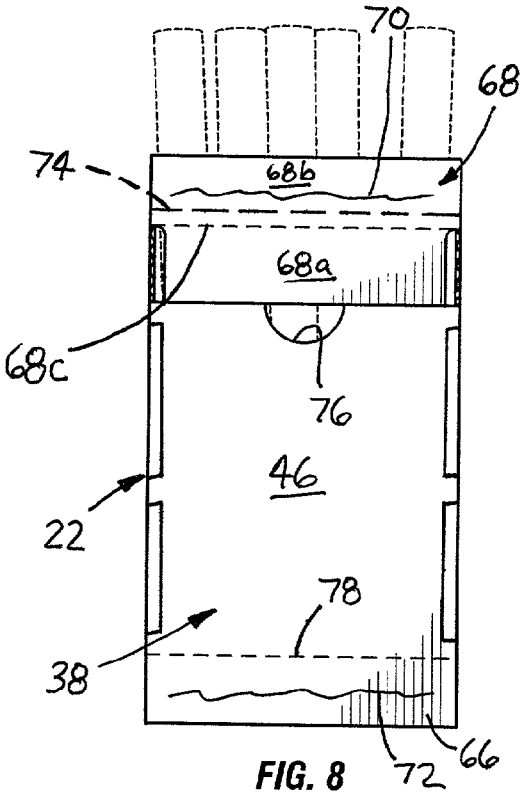
FIG. 8 is a front elevational view showing a double-folded portion of a reinforced top rail.
Figure 9:
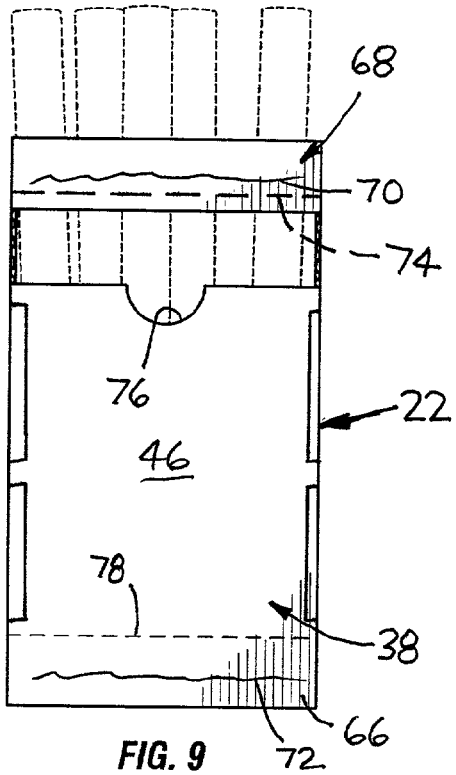
FIG. 9 is a front elevational view similar to FIG. 8 with the double-folded portion in an operative position.
Figure 10:
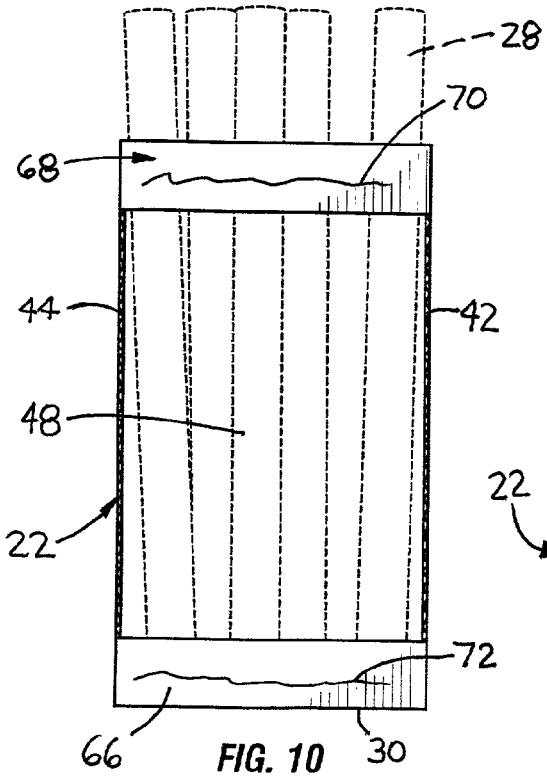
FIG. 10 is a front elevational view similar to FIG. 9 with the panel portion removed for displaying the products.
Figure 11:
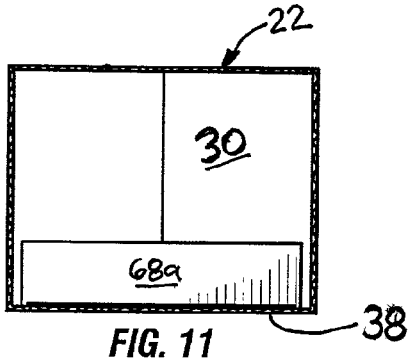
FIG. 11 is a top elevational view showing a double-folded portion of the reinforced top rail.
Figure 12:
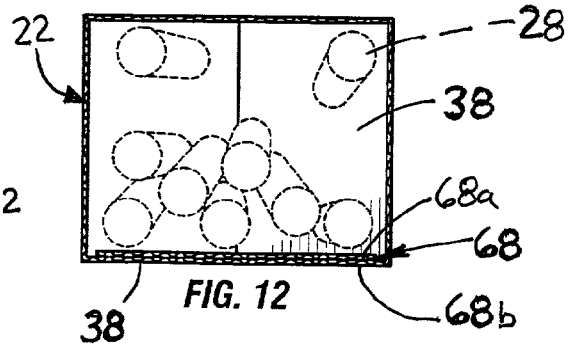
FIG. 12 is a top plan view similar to FIG. 11 showing the double-folded portion of the reinforced top rail in an operative position.

By comparing FIGS. 3 and 10, it will be appreciated that the removable panel portion 46 is formed in the front wall panel 38 at a point spaced above the bottom panel 30 of the display box 22 and is integral with and spans the side wall panels 42 and 44 at a plurality of discreet points 46*a*–*f* along front edges 42*a* and 44*a* thereof.

Referring once again to FIGS. 1 and 2, the shipping sleeve 24 is defined by a top panel 50 and a plurality of downwardly extending wall panels such as 52, 54 and 56 together forming a telescoping enclosure 58. The shipping sleeve 24 includes an open bottom 60 having a generally rectangular configuration defined by a bottom wall panel edge 62 disposed opposite the top panel 50. The wall panels include front and rear wall panels 52 and 64 and a pair of side wall panels 54 and 56 and the display box 22 can be positioned in the telescoping enclosure 58 (compare FIGS. 1 and 2). With this arrangement, it will be appreciated that the shipping sleeve 24 completely covers the open top 34 of the display box 22 to protect the elongated holiday gift wrap tubes 28 contained therewithin.

As previously mentioned, the product shipping and display carton 20 includes a removable fastener 26 such as carton tape or the like. The removable fastener 26 serves to secure the shipping sleeve 24 to the display box 22 during shipment but permits removal of the shipping sleeve 24 from the display box 22 after shipment to display the elongated holiday gift wrap tubes 28 disposed within the carrying and supporting enclosure 32 of the display box 22. In this connection, the removable fastener 26 may either be completely removed or slit in the case of carton tape to permit easy telescoping removal of the shipping sleeve 24 from the display box 22 when the product shipping and display carton 20 has arrived at its destination such as a retail store.

Referring now to FIGS. 8–12, the display box 22 is formed such that the front wall panel 38 comprises a bottom rail 66 and a reinforced top rail generally designated 68 for supporting the elongated holiday gift wrap tubes 28 vertically within the display box 22. It may be advantageous for the display box 22 and the shipping sleeve 24 to both be formed of a corrugated material due to the relatively inexpensive nature of such construction and the display box 22 may have printed product-related indicia 70 and graphics 72 to assist and attract a consumer at the point of sale. As will be appreciated, the printing of product-related indicia 70 and graphics 72 will attract and assist the consumer at the point of sale in making a decision as to purchase in a self-service manner.

Still referring to FIGS. 8–12, the reinforced top rail 68 of the front wall 38 may be formed of a reverse-folded portion 68*a* of the corrugated material to provide a double thickness thereof. In particular, the reverse-folded portion 68*a* may be folded inwardly and upwardly about foldline 68*c* to abut and be adhesively secured to the outwardly facing portion 68*b* of the reinforced top rail 68. With this arrangement, a wire 74 may be disposed between the double thickness provided by the reverse-folded portion 68*a* and the outwardly facing portion 68*b* of the reinforced top rail 68 to provide additional reinforcement for the top rail 68 of the front wall 38. By referring to FIG. 10, it can be seen that the elongated holiday gift wrap tubes 28 are fully supported within the carrying and supporting enclosure 32 by the bottom rail 66 and the reinforced top rail 68. The removable panel portion 46 can easily be removed by simply placing the hand in the cutout 76 and pulling outwardly to sever the discreet points 46*a*–*f* where it is initially integral with the front edges 42*a* and 44*a* of the side walls 42 and 44. As will also be appreciated, a line of perforation 78 may be formed between the removable panel portion 46 and the bottom rail 66 to further assist in removal of the panel portion 46.

When this has been accomplished, the elongated holiday gift wrap tubes 28 are almost completely visible through the viewing window 48 and can be removed either through the open top 34 or by raising them until the bottom end is disposed above the bottom rail 66, pulling them outwardly through the viewing window 48, and pulling them downwardly until the top end clears the reinforced top rail 68. As a result, the display box 22 can either be placed on the floor or on a shelf wherein the viewing window 48 is substantially at eye level providing significant versatility.

From the foregoing, it will be appreciated that the removable panel portion 46 of the display box 22 not only permits full visibility of the elongated holiday gift wrap tubes 28 but also provides rigidity for the display box 22 during shipment. Once the product shipping and display carton 20 is delivered to a store, and the shipping sleeve 22 is removed to prepare the display box 22 for placement in the store, the rigidity is no longer needed. However, the reinforced top rail 68 provides the necessary strength to support the weight of the elongated holiday gift wrap tubes 28 when the display box 22 is full or nearly full and encounters the stress caused by movement and removal of the tubes by customers.

With the present invention, it is no longer necessary to remove all of the elongated holiday gift wrap tubes from a shipping carton, physically transport and load the rolls onto the appropriate shelf in the self-service area of a store, and then provide necessary restraint hardware to hold the tubes in place. In addition, since the display box 22 is pre-printed with necessary information and desirable graphics, there is no need for store personnel to print out and apply signage to provide information at the display area. Of course, while described in connection with elongated holiday gift wrap tubes, the product shipping and display carton may find many others uses for it is necessary to ship products in bulk for display at the point of sale in a retail store.

While a preferred embodiment of the invention has been set forth in detail in the foregoing description, it will be appreciated that the invention is only to be limited by the scope of the appended claims.

What is claimed is:

1. A product shipping and display carton and a plurality of elongated, tubular shaped products contained therein, comprising:

a display box defined by a bottom panel and an upwardly extending wall panel together forming a product carrying enclosure, said display box having an open top defined by a top wall panel edge opposite said bottom panel, said wall panel having a top product-restraining rail and a removable panel portion below said open top and said top product-restraining rail, defining a product viewing window in said display box, said product viewing window having a height that is generally smaller than a length of said elongated, tubular shaped products contained within said display box, said height of said product viewing window being generally perpendicular to said top wall panel edge and said top product-restraining rail;

said top product-restraining rail positioned on said upwardly extending wall panel to engage one or more of said plurality of elongated, tubular shaped products to hold said plurality of elongated, tubular shaped products within said display box, and to prevent said plurality of elongated, tubular shaped products from falling out of said display box after said removable panel portion has been removed and while said plurality of elongated, tubular shaped products are on display; and a shipping sleeve defined by a top panel and a downwardly extending wall panel together forming a telescoping enclosure, said shipping sleeve having an open bottom defined by a bottom wall panel edge opposite said top panel, said display box being positioned in said telescoping enclosure such that said open top and said upwardly extending wall panel are substantially entirely covered by said shipping sleeve.

2. The product shipping and display carton of claim 1 wherein said upwardly extending wall panel is defined by a front wall, a rear wall, and a pair of side walls and said removable panel portion is formed in said front wall at a point spaced above said bottom panel.

3. The product shipping and display carton of claim 2 wherein said removable panel portion extends entirely from one of said side walls to the other of said side walls and is integrally associated with said side walls at a plurality of discrete points along front edges thereof.

4. The product shipping and display carton of claim 2 wherein said front wall comprises a bottom product-restraining rail integral with said bottom wall panel and said top product-restraining rail integral with said side walls adjacent said top wall panel edge, and wherein said bottom product-restraining rail is also positioned on said upwardly extending wall panel to engage one or more of said plurality of elongated, tubular shaped products to hold said plurality of elongated, tubular shaped products within said display box, and to prevent said plurality of elongated, tubular shaped products from falling out of said display box after said removable panel portion has been removed and while said plurality of elongated, tubular shaped products are on display.

5. The product shipping and display carton of claim 1 wherein each of said plurality of elongated, tubular shaped products have opposing ends and wherein said top product-restraining rail is positioned on said upwardly extending wall panel to engage at least a portion of one of said opposing ends of one or more of said plurality of elongated, tubular shaped products to hold said plurality of elongated, tubular shaped products within said display box.

6. A product shipping and display carton and a plurality of elongated gift wrap tubes contained therein, comprising:

a display box defined by a bottom panel and a plurality of upwardly extending wall panels together forming a product carrying and supporting enclosure for said plurality of elongated gift wrap tubes, said display box including a top having a generally rectangular shape and being defined by a top wall panel edge disposed opposite said bottom panel, said wall panels including front and rear walls and a pair of side walls and said front wall having a top rail for supporting said plurality of elongated gift wrap tubes within said display box and a removable panel portion at a point spaced below said top rail in said display box to form a viewing window therewithin, said viewing window having a height that is generally smaller than a length of said plurality of elongated gift wrap tubes contained within said display box, said height of said viewing window being generally perpendicular to said top wall panel edge and said top rail;

said top rail positioned on said front wall to engage one or more of said plurality of elongated gift wrap tubes to hold said plurality of elongated gift wrap tubes within said display box, and said top rail adapted to prevent said plurality of elongated gift wrap tubes from falling out of said display box after said removable panel portion has been removed and while said plurality of elongated gift wrap tubes are on display; and a shipping sleeve defined by a top panel and a plurality of downwardly extending wall panels together forming a telescoping enclosure, said shipping sleeve including an open bottom having a generally rectangular configuration defined by a bottom wall panel edge disposed opposite said top panel, said wall panels including front and rear walls and a pair of side walls and said display box being adapted to be positioned within said telescoping enclosure;

said shipping sleeve completely covering said open top of said display box and substantially entirely covering said plurality of upwardly extending wall panels to protect said plurality of elongated gift wrap tubes contained therewithin.

7. The product shipping and display carton of claim 6 wherein said removable panel portion is formed as a portion of said front wall at a point spaced above said bottom panel of said display box.

8. The product shipping and display carton of claim 6 wherein said removable panel portion is integral with and spans the distance between said side walls at a plurality of discrete points along front edges thereof.

9. The product shipping and display carton of claim 6 wherein said front wall further comprises a bottom rail for supporting said plurality of elongated gift wrap tubes within said display box, wherein said bottom rail is also positioned on said front wall to engage one or more of said plurality of elongated gift wrap tubes to hold said plurality of elongated gift wrap tubes within said display box, and wherein said bottom rail is adapted to prevent said a plurality of elongated gift wrapped tubes from falling out of said display box after said removable panel portion has been removed and while said plurality of elongated, tubular shaped products are on display.

10. The product shipping and display carton of claim 6 wherein each of said plurality of elongated gift wrapped tubes have opposing ends and wherein said top rail is positioned on said front wall panel to engage at least a portion of one of said opposing ends of one or more of said plurality of elongated gift wrapped tubes to hold said plurality of elongated gift wrapped tubes within said display box.

11. A product shipping and display carton and a plurality of elongated gift wrap tubes contained therein, comprising:

a display box defined by a bottom panel and a plurality of upwardly extending wall panels together forming a carrying and supporting enclosure for said plurality of elongated gift wrap tubes, said display box including a top having a generally rectangular configuration defined by a lop wall panel edge disposed opposite said bottom panel, said wall panels including front and rear wall panels and a pair of side wall panels and said front wall panel having a top rail for supporting said plurality of elongated gift wrap tubes within said display box and a removable panel portion below said open top and said top rail to form a viewing window;

said removable panel portion being formed in said front wall panel at a point spaced above said bottom panel of said display box;

said viewing window having a height that is generally smaller than a length of said plurality of elongated gift wrap tubes contained within said display box, said height of said viewing window being generally perpendicular to said top wall panel edge and said top rail;

said top rail positioned on said front wall to engage one or more of said plurality of elongated gift wrap tubes to hold said plurality of elongated gift wrap tubes within said display box, and said top rail adapted to prevent said plurality of elongated gift wrap tubes from falling out of said display box after said removable panel portion has been removed and while said plurality of elongated gift wrap tubes are on display; and a shipping sleeve defined by a top panel and a plurality of downwardly extending wall panels together forming a telescoping enclosure, said shipping sleeve including an open bottom having a generally rectangular configuration defined by a bottom wall panel edge disposed opposite said top panel, said wall panels including front and rear wall panels and a pair of side wall panels and said display box being positioned in said telescoping enclosure;

said shipping sleeve completely covering said top of said display box and substantially entirely covering said plurality of upwardly extending wall panels to protect said plurality of elongated gift wrap tubes contained therewithin; and a removable fastener for securing said shipping sleeve to said display box during shipment and permitting removal of said shipping sleeve from said display box after shipment to display said plurality of elongated gift wrap tubes disposed within said carrying and supporting enclosure of said display box.

12. The product shipping and display carton of claim 11 wherein said front wall further comprises a bottom rail for supporting said plurality of elongated gift wrap tubes within said display box, wherein said bottom rail is also positioned on said front wall to engage one or more of said plurality of elongated gift wrap tubes to hold said plurality of elongated gift wrap tubes within said display box, and wherein said bottom rail is adapted to prevent said a plurality of elongated gift wrapped tubes from falling out of said display box after said removable panel portion has been removed and while said plurality of elongated, tubular shaped products are on display.

13. The product shipping and display carton of claim 12 wherein each of said plurality of elongated gift wrapped tubes have opposing ends and wherein said top rail is positioned on said front wall panel to engage at least a portion of one of said opposing ends of one or more of said plurality of elongated gift wrapped tubes to hold said plurality of elongated gift wrapped tubes within said display box.

14. The product shipping and display carton of claim 13 wherein said top rail of said front wall is formed of a reverse folded portion of said corrugated material to provide a double thickness thereof.

15. The product shipping and display carton of claim 14 including a wire disposed between said double thickness of said corrugated material to provide additional reinforcement for said top rail of said front wall.

* * * * *

UNITED STATES PATENT AND TRADEMARK OFFICE

CERTIFICATE OF CORRECTION

PATENT NO. : 7,213,707 B2
APPLICATION NO. : 10/099423
DATED : May 8, 2007
INVENTOR(S) : William Hubbs et al.

It is certified that error appears in the above-identified patent and that said Letters Patent is hereby corrected as shown below:

At Column 6, line 48, “said open top” should be -- said top --.

At Column 7, line 23, “lop wall” should be -- top wall --.

At Column 8, line 27, “said a” should be -- said --.

Signed and Sealed this

Thirteenth Day of November, 2007

JON W. DUDAS
*Director of the United States Patent and Trademark Office*